US005988448A

United States Patent [19]

Foth

[11] Patent Number: 5,988,448

[45] Date of Patent: Nov. 23, 1999

[54] VACUUM RELEASE CONTAINER CAP

[76] Inventor: Gary S. Foth, 25151 DeSalle St., Laguna Hills, Calif. 92653

[21] Appl. No.: 08/932,130

[22] Filed: Sep. 18, 1997

[51] Int. Cl.[6] ..... B67D 5/58

[52] U.S. Cl. ..... 222/189.09; 222/212; 222/481.5; 222/493; 222/525

[58] Field of Search ..... 222/189.09, 212, 222/481.5, 484, 491, 492, 493, 494, 523, 525

[56] References Cited

U.S. PATENT DOCUMENTS

| | | | |
|---|---|---|---|
| 3,157,323 | 11/1964 | Kitterman | 222/520 |
| 3,201,013 | 8/1965 | Porter et al. | 222/525 |
| 3,228,418 | 1/1966 | Rosback et al. | 137/516.17 |
| 3,481,500 | 12/1969 | Palma | 215/11 |
| 3,878,962 | 4/1975 | Holbrook et al. | 215/309 |
| 4,489,883 | 12/1984 | Anderson | 236/92 C |
| 4,513,891 | 4/1985 | Hain et al. | 222/494 |
| 5,135,137 | 8/1992 | Rudick | 222/484 |
| 5,273,191 | 12/1993 | Meshberg | 222/494 |
| 5,320,254 | 6/1994 | Ranalletta et al. | 222/189.09 |
| 5,366,115 | 11/1994 | Kersten et al. | 222/481.5 |
| 5,577,625 | 11/1996 | Baird et al. | 222/212 |
| 5,605,257 | 2/1997 | Beard | 222/189.09 |
| 5,785,858 | 7/1998 | Webb | 222/189.09 |

FOREIGN PATENT DOCUMENTS

| | | | |
|---|---|---|---|
| 2268737 | 1/1994 | United Kingdom | 222/481.5 |

*Primary Examiner*—Joseph A. Kaufman
*Attorney, Agent, or Firm*—Knobbe, Martens, Olson & Bear LLP

[57] ABSTRACT

A vacuum release container cap comprises a body, a closure device, and a seal member. The body has at least two passages formed therein, a liquid passage for the flow of liquid into and out of the container, and a gas passage for the flow of air. The closure device is mounted on the body for closing each of the passages. The closure device automatically opens the gas passage while opening the liquid passage. The seal member is mounted in the gas passage, which allows the passage of air into the container, but does not allow the passage of liquid out of the container though the gas passage.

15 Claims, 3 Drawing Sheets

VACUUM RELEASE CONTAINER CAP

The present invention relates to a container capable of releasing vacuum generated inside the container due to the consumption of the liquid contained in the container, and, more specifically, to a vacuum relief cap used with such container.

BACKGROUND OF THE INVENTION

It has been constantly experienced by many that, when liquid is drained out of a sealed container, the liquid flow will slow down as vacuum builds up inside the container and eventually the flow will totally stop. This may cause inconvenience and discomfort for the user, particularly when a drinking bottle or a sport bottle is involved. For example, when using a conventional drinking bottle, the user has to stop drinking from time to time to release the built-up vacuum inside the bottle.

Different types of container caps are available in the art. U.S. Pat. No. 3,481,500 to Palma discloses a valve used with a bottle. The valve has a built-in lip which allows air to enter the bottle when vacuum is built up in the bottle due to liquid flow out of the bottle. The valve is in the form of a rubber nipple used with a nursing bottle. However, on the nursing bottle disclosed by Palma, the nipple does not seal the bottle, i.e. the passage for liquid and the passage for air are open to the atmosphere all the time. Obviously, for most applications, a container or a drinking bottle needs to be sealed for handling and preventing it from leakage and possible contamination.

U.S. Pat. No. 3,201,013 discloses a dispensing and closure cap for a liquid container. The cap has a stopper with an outlet hole which engages with a closure pin and a liquid passage. When the stopper is pushed against the bottle, the closure pin is forced into the outlet hole of the stopper, and the flow passage is blocked. When the stopper is pulled outwardly, the hole is out of touch with the closure pin, and thus, the flow passage is opened. Although the cap can seal the container and can be opened easily, this system does not have an air passage for releasing the vacuum generated due to the consumption of the liquid.

Therefore, there exists a need for a container which is sealed when not in use and which can automatically release vacuum during the consumption of the liquid content.

SUMMARY OF THE INVENTION

In one aspect of the present invention, a liquid container cap is provided. The cap is adapted to automatically release vacuum generated during expulsion of liquid contained in the liquid container. The liquid container cap comprises:

- a body having a cylindrical lower portion for receiving the liquid container, an upper portion with a central hole along a longitudinal axis of the body, and a middle portion having a disk shape connecting the lower and the upper portions;
- a cylindrical central piece having a liquid passage along a longitudinal axis of the cylindrical central piece, a top section, a middle section, a bottom section, and an outer surface, the outer surface having a stepped configuration with the top section having a larger outer diameter than that of the middle section, the central piece mounted in the central hole of the upper portion of the body with the longitudinal axis of the cylindrical central piece parallel to that of the body, wherein the outer surface of the middle section of the central piece and the inner surface of the upper portion of the body define a gas passage, wherein a stopper is mounted on the top section of the central piece without blocking the liquid passage;
- a seal sheet having a disk shape with a first edge and a second edge and placed in the gas passage with the first edge adjacent the outer surface of the central piece between the bottom section and the middle section and the second edge extending outwardly along an inner surface of the middle portion of the body; and
- a closure having a hole aligned with the stopper and a cylindrical wall for engaging with the body and the central piece, said closure slidably coupled to the top section of the central piece and adapted to close or open the liquid passage and the gas passage through the engagement between said closure and the central piece and between the closure and the upper portion of the body.

In another aspect of the present invention, a bottle cap is provided. The bottle cap comprises:

- a body having a through hole along a longitudinal axis of the body;
- a central piece having a liquid passage positioned in the through hole of the body, wherein the outer surface of the central piece and the inner surface of body define a gas passage;
- a seal member placed in the gas passage, which allows the passage of gas but not the passage of liquid; and
- a closure coupled to the central piece and adapted to close or open the liquid passage and the gas passage simultaneously.

In still another aspect of the present invention, a cap for a container is provided. The cap comprises:

- a body having at least two passages formed therein, a first passage for the flow of liquid into and out of the container, and a second passage for the flow of gas;
- a closure device mounted on the body for closing each of said passages, the closure device automatically opening the second passage while opening the first passage; and
- a seal member mounted in the second passage, the seal member adapted to allow the passage of gas but not the passage of liquid.

The vacuum release cap of the present invention can be used with liquid containers where vacuum release is desirable. Particularly, the vacuum release cap can be used with different types of bottles such as biking, hiking, and workout bottles, and with various liquids such as water, sport drinks, and fruit juices. With the vacuum release cap of the present invention, consumers can drink without stopping to release the vacuum generated in the drinking bottle.

DETAILED DESCRIPTION OF THE PREFERRED EMBODIMENTS

Figure 1:
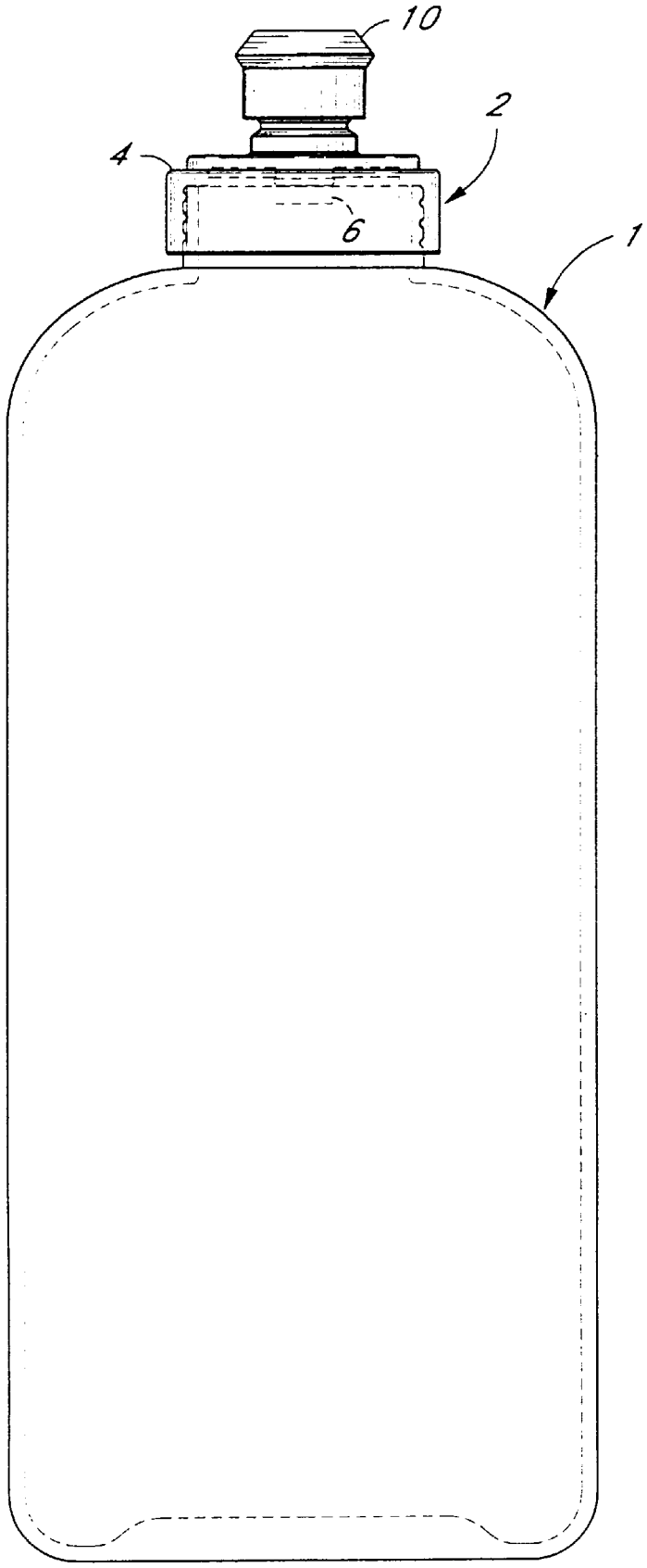
FIG. 1 shows a typical drinking bottle with a cap.

Preferably, in one aspect of the present invention, the vacuum release container cap comprises three parts: a body, a closure, and a seal member; although, other configurations and combinations of components are also within the scope of the invention.

The body has at least one liquid passage for the flow of liquid into and out of the container and at least one gas passage for the flow of gas or air into the container to release the vacuum built up inside the container. The gas passage is designed to substantially prevent liquid in the container from flowing out through the gas passage under normal operational conditions.

The liquid and the gas passages are normally closed during the storage of the container so that leakage and contamination from outside sources are minimized. When the container is ready for use, the liquid passage and the gas passage are opened up. Thus, liquid communication between the inside of the container and the outside is established through the liquid passage, and gas communication between the inside and the outside is established through the gas passage. As the expulsion of the liquid in the container continues through the liquid passage, vacuum starts to build up in the container, which tends to slow down the liquid flow and eventually stop it if the vacuum is not released. This will cause discomfort and inconvenience for the user. For example, in the case of a sport drinking bottle where quick and comfortable access to the liquid in a container is important, it is very desirable to avoid such a problem. Thus, the presence of the gas passage can prevent this from happening or at least significantly minimize the problem. Because the gas passage keeps the inside of the container in gas communication with the outside atmosphere, when vacuum starts to accumulate inside the container, air will be forced into the container through the gas passage due to the pressure difference between the inside and the outside of the container. Thus, the vacuum is released and a steady and easy flow of liquid through the liquid passage is maintained.

Preferably, the gas passage is a one-way passage in the sense that it only allows gas to flow into the container, but does not allow liquid to flow out of the container. Preferably, this is achieved in various ways. One of them is a physical block by placing a solid seal member in the gas passage, so that the gas passage is normally closed until pressure difference between the atmosphere and inside of the container becomes large enough to push the seal member away and open the gas passage. The other is based on fluid kinetics, i.e. the same flow path will impose tar higher resistance to a liquid flow than to a gas flow. Thus, along the gas passage, flow path areas can be generated in various ways, which have resistance high enough to stop or significantly reduce a liquid flow, but not enough to stop a gas flow. For example, such flow path areas can be in the form of very narrow gaps, or very small porous channels. Different materials also exhibit different resistance to liquid. Thus, resistant flow path areas made of hydrophobic material will have higher resistance to water flow or bleed.

In order to control the opening and closing of the passages, a closure is provided to engage with the body. During storage of the container, the closure is in a closed position, and the liquid passage is closed and sealed through the engagement of the closure and the body. Furthermore, when the closure is in this closed position, the gas passage is also closed and sealed. Thus, in normal storage condition, the container is well sealed and prevented from contamination from outside sources.

The body can be molded as an integral structure, or made from separate parts. For example, the central piece can be made separately, and then inserted into the upper portion of the body. The body can be made of conventional synthetic materials, such as polyethylene, polypropylene, or other suitable materials. The closure can be made of similar materials. Preferably, the shape and dimension of various parts of the body and the closure can be easily modified and adjusted to achieve similar vacuum release results as discussed above.

In addition to the body and the closure, the preferred vacuum release container cap usually also comprises a seal member to stop or significantly reduce liquid flow or leakage through the gas passage. There are several alternate ways to accomplish this.

In one embodiment, the seal member is a solid flexible sheet. Preferably, it is resilient. The seal member is placed in the gas passage to serve as a one-way valve. The solid flexible sheet is normally in a position blocking the gas passage as described below. Particularly, during the expulsion of the liquid from the container, the liquid in the container will force the solid flexible sheet against the gas passage, so that the gas passage is blocked and no liquid can flow out through the gas passage. However, as the vacuum is built up in the container, the solid flexible sheet is forced away from the gas passage due to the pressure difference such that air is sucked into the container to release the vacuum.

Since the force acting on the seal member due to the pressure difference is roughly proportional to the area of the seal member exposed to the gas passage, the size of the exposed area of the seal member, or the cross sectional area of the gas passage adjacent the seal member, should be large enough to provide enough force to move the seal member away from the gas passage under certain pressure differences or vacuum. The critical vacuum value required to move the seal member should not be too high to cause difficulty for the expulsion of the liquid. A large exposed area also provides faster vacuum release. But the exposed area should not too large to cause liquid leakage problem. It is usually desirable to have a gas passage with a changing cross section, such that the cross sectional area adjacent the seal member is larger than that near the end opened to the atmosphere. The seal member can be made of rubber or other synthetic materials. It is also possible to use a seal member with other shapes (e.g., such as a ball-shaped seal member) in conjunction with gas passages of different shape.

In another embodiment, the seal member is made of porous material and secured in the gas passage. The small paths in the porous material will impose enough resistance to the liquid so that no significant amount of liquid can travel through the porous material, while gas or air can pass through the porous material easily and quickly as soon as a vacuum is generated in the container. Various porous materials are available for use in the present invention.

It is also possible to avoid using a seal member in the container cap of the present invention. In another aspect of the invention, very narrow gaps or capillary channels can be provided in the gas passage. Because of the surface tension, it will be difficult for liquid to penetrate those small conduits while gas will be able to flow through.

Obviously, many options and modifications of the vacuum release cap arc possible. Preferably, the choice of the gas passage dimension and the seal member should be such that liquid flow through the gas passage under operational conditions is stopped or at least significantly reduced and the gas flow into the container is fast enough to allow quick release of vacuum in the container.

Various aspects of the present invention are described in more detail below by reference to the drawings.

FIG. 1 shows a drinking bottle 1 with a cap 2 of the present invention.

Figure 2:
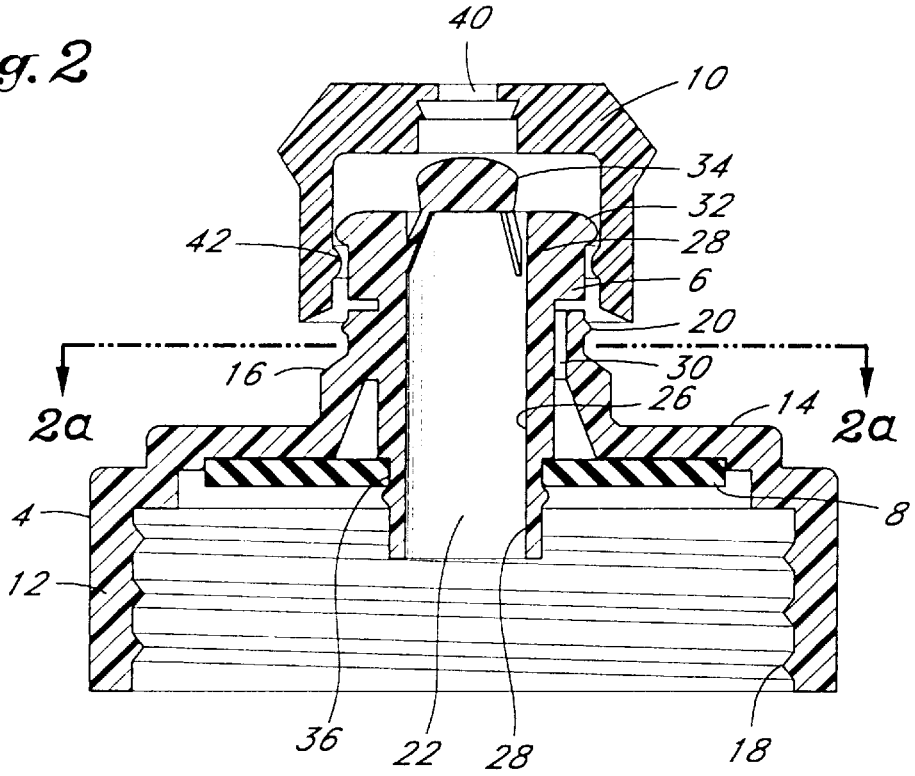
FIG. 2 is a cross section view of one embodiment of a vacuum release cap of the present invention.

FIG. 2 shows a sectional view of the cap 2. As shown in FIG. 2, cap 2 has a body 4 with a central piece 6, a seal member 8, and a closure 10. Body 4 includes a lower portion 12, an upper portion 16, and a middle portion 14 connecting the upper and lower portions. The lower portion 12 has a cylindrical wall extending along a longitudinal axis of the body 4. The cylindrical wall of the lower portion 12 has thread 18 on its inner surface for receiving and sealing the neck of bottle 1. The cylindrical upper portion 16 has a smaller diameter than that of the lower portion 12. There is a projection 20 on the outer surface near the upper edge of the upper portion 16. Projection 20 lies in a plane substantially perpendicular to the longitudinal axis of the body 4. The inner surface of the upper portion 16 is angled so that the inner diameter of the upper portion 16 is larger near the middle portion 14. The middle portion 14 has a disk shape connecting the upper portion 16 and the lower portion 12. The inner surface of the middle portion is configured in a stepped structure as shown in FIG. 2 for accommodating the seal member 8.

Central piece 6 has a cylindrical wall extending along a longitudinal axis defining a liquid passage 22. The central piece 6 can be divided into a top section 24, a middle section 26, and a bottom section 28. The outer surface of the central piece 6 has a stepped structure. The central piece 6 is concentrically located in the central hole of the upper portion 16 of the body 4 and extends into the lower portion 12 along the longitudinal axis of the body 4. The outer surface of the middle section 26 of the central piece 6 and the inner surface of the upper portion 16 of the body 4 define a gas passage 30. The bottom section of the central piece 6 extrudes into the lower portion 12 of the body 4, so as to protect bubbles from entering the liquid passage 22. There is a projection 32 on the outer surface near the top edge of the top section 24 of the central piece 6 for engaging with the closure 10 and preventing the closure 10 from being removed form the central piece 6. There is also a notch 36 on the outer surface of the central piece 6 between the middle section 26 and the bottom section 28. Notch 36 is used to receive and position the seal member 8. A stopper 34 is mounted on the top section 24 of the central piece 6. Stopper 34 itself does not block the liquid passage 22. But when engaged with the closure 10, the liquid passage 22 can be closed or opened by pushing or pulling the closure 10, respectively.

Figure 2A:
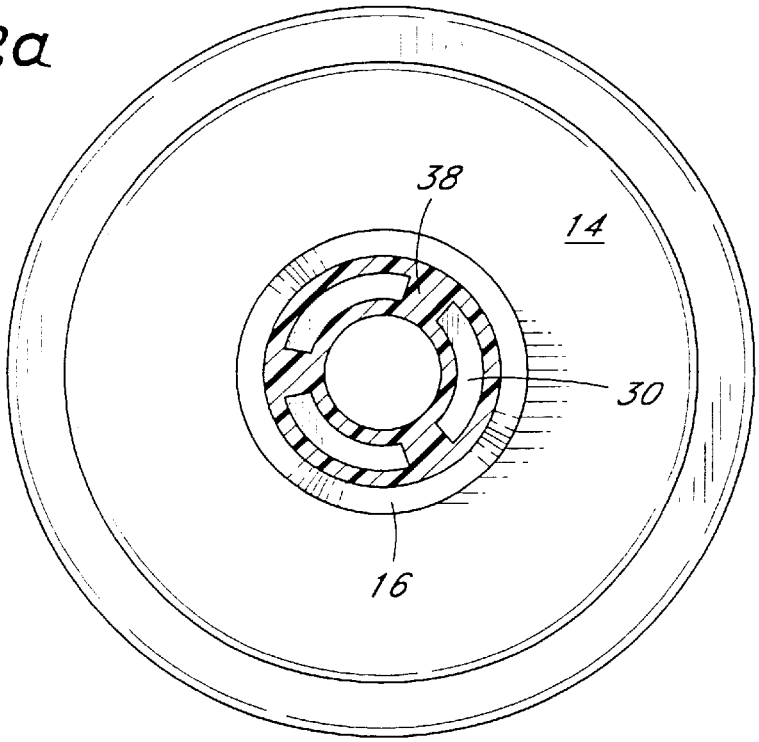
FIG. 2*a* is a transverse cross section view of the cap of FIG. 2.

Body 4 and central piece 6 can be coupled in different ways. For example, the central piece 6 can be made separately and slid into the upper portion 16 of the body 4. Body 4, central piece 6, and stopper 34 can also be molded into an integral structure. FIGS. 2 and 2*a* show an example of how the central piece 6 and the body are connected to each other. As shown in FIG. 2*a,* there are three connection pieces 38 connecting the inner surface of the upper portion 16 of the body 4 and the outer surface of the middle section 26 of the central piece 6. Various numbers of connection pieces 38 can be used. In a similar way, the stopper 34 is mounted to the top section 24 of the central piece 6.

The closure 10 has a central hole 40 aligned with the stopper 34 and the liquid passage 22. The closure 10 is slidably mounted to the top section 24 of the central piece 6. FIG. 2 shows the situation where the closure 10 is in an open position. Under this open position, the liquid passage 22 and the hole 40 is connected and the liquid can flow out through the liquid passage. In the meantime, due to the engagement between a projection 42 on the lower inner surface of the closure 10 and the projection 32 on the outer surface of the top section 24 of the central piece 6, a seal is formed between the closure 10 and the central piece 6. Thus, the liquid only flows through the liquid passage 22 and the hole 40, but not through the junction between the lower part of the closure 10 and the top section 24 of the central piece 6. Under this open position, the gas passage 30 is also opened, so that air or gas can flow into the container through the gas passage 30 once vacuum is built up to certain point in the container.

During storage the closure is normally in a closed position. In this case the closure 10 is pushed against the body 4. Under this closed position, the liquid passage 22 is closed and sealed because of the engagement between the hole 40 in the closure 10 and the stopper 34, and the engagement between the inner surface of the closure 10 and outer surface of the top section 24 of the central piece 6. In the meantime, the gas passage 30 is also closed and sealed because of the engagement between the projection 42 on the lower inner surface of the closure 10 and the projection 20 on the outer surface near the upper edge of the upper section 16 of the body 4. Because of the sloped shape of the cross section of the projections 42 and 20, when the closure 10 is pushed toward the central piece 6, the projection 42 will become in touch with the projection 20 and force it inwardly, and thus a good seal is formed between the two projections. It is also possible to close and seal the gas passage 30 by closing the gas passage by similar action between the two projections. Thus, by simple movement of the closure 10, the liquid passage 22 and the gas passage 30 can be simultaneously opened or closed.

The seal member 8 as shown in FIG. 2 has a flat disk shape with an inner edge and an outer edge. The seal member 8 is placed against the gas passage 30 with the inner edge adjacent or mounted to the notch 36 and the outer edge extending radially outwardly along the middle portion 14 of the body 4. At least a portion of the seal member 8 rests on the inner surface of the middle portion 14 of the body 4. As shown in FIG. 2, the gas passage 30 has a changing cross sectional area. The cross sectional area adjacent the seal member 8 is larger than that near the other end, which provides higher sensitivity to vacuum accumulation in the container.

The inner edge of the seal member 8 is located at the junction between the bottom section 28 and the middle section 26 of the central piece 6, and the bottom section 28 extends into the lower portion 12 of the body 4. This structure will prevent air bubbles form being drawn into the consumed liquid through the extended liquid passage 22. The outer edge of the seal member 8 partially lies on the inner surface of the middle portion 14 and extends outwardly along a radial direction. FIG. 2 shows a stepped structure of the inner surface of the middle portion 14. However, the inner surface of the middle portion 14 does not have to have a stepped structure. For example, the middle portion 14 may have a flat inner surface and the outer edge of the seal member 8 may extend all the way to the inner surface of the lower portion 12. In the later case, the seal member also facilitates the sealing between the cap and the bottle because it functions like a gasket between the upper edge of the bottle neck and the cap.

FIGS. 3–6 illustrate different seal member structures.

Figure 3:
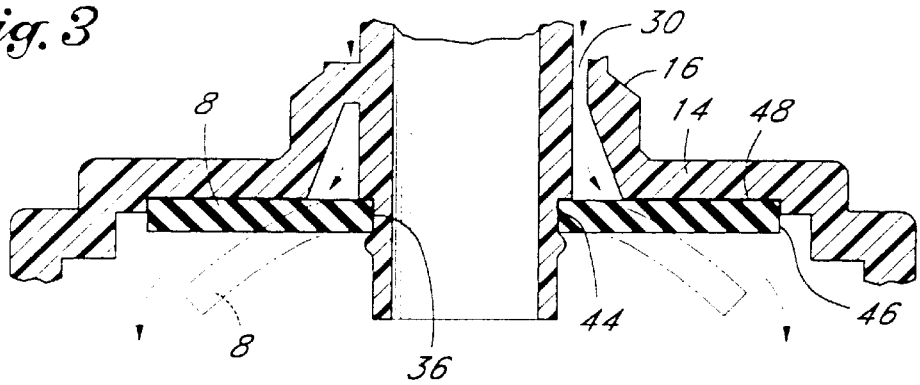
FIG. 3 is an enlarged cross section of the seal member and air flow passage showing one embodiment of the present invention.

In the embodiment shown in FIG. 3, the seal member 8 is a solid flexible sheet having a disk shape, which is made of rubber or other flexible material. The inner edge 44 of the seal member 8 is mounted to the notch 36 on the outer surface at the junction of the bottom section 28 and the middle section 26 of the central piece 6. Preferably, the inner edge 44 of the seal member 8 is glued to the notch 36. The outer edge 46 of the seal member 8 is free, and a portion of the seal member 8 movably sits in the stepped inner surface 48 of the middle portion 14 of the body 4. During the expulsion or consumption of the liquid in the container, the seal member 8 usually is forced against the stepped inner surface 48 by the liquid. However, as a negative pressure differential is built up inside the container, the force acting on the seal member in the opposite direction, i.e., forcing the seal member away from the stepped inner surface 48, continues to increase. At a certain point, this force will overcome the opposite force due to the liquid column weight and other external forces, and the free edge 46 of the seal member 8 will be forced away from the stepped inner surface 48 (as shown by the dot-and-dash line). Thus, air will be sucked into the container through the opened gas passage 30 as shown by the arrow. This assures that an excessively high vacuum can never be built up in the container. In other words, the vacuum level will be controlled under a certain level at which the smooth flow of liquid through the liquid passage 22 is not affected. Such level of control can be achieved by adjusting the dimension of the cross sectional area of the gas passage 30 adjacent the seal member. The angle between the plane of the seal member surface and the longitudinal axis of the gas passage 30 also can be adjusted.

Figure 4:
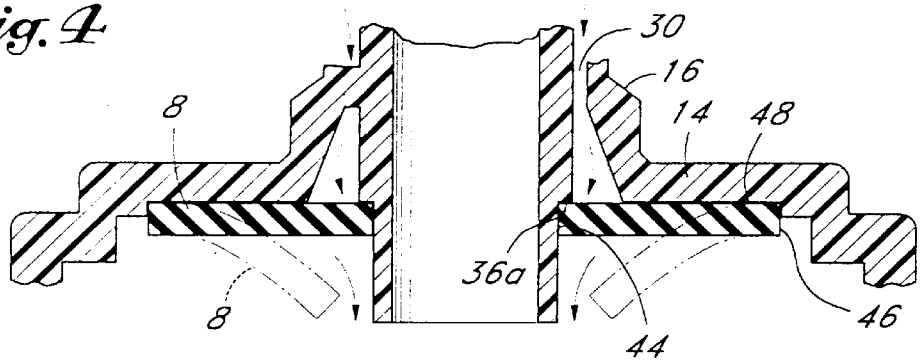
FIG. 4 is an enlarged cross section of the seal member and air flow passage showing another embodiment of the present invention.

FIG. 4 shows another embodiment. In this embodiment the outer edge 48 of the seal member 8 is secured to the inner surface of the middle portion 14 of the body, for example by glue. The seal member 8 is a solid flexible sheet having a disk shape and made of rubber or other flexible material. The inner edge 44 is free and normally sits on the step 36*a* on the outer surface of the central piece 6 near the junction of the middle section 26 and the bottom section 28. Another option is to have a middle portion 14 with a flat inner surface structure and extend the outer edge 46 of the seal piece 8 to the inner wall of the lower portion 12 of the body 4, so that when the cap is screwed onto the bottle neck the outer edge 46 will positioned between the inner surface of the middle portion 14 and the upper edge of the bottle neck. In this way, the sealing between the cap 2 and the bottle 1 is facilitated by the presence of the seal member 8.

Figure 5:
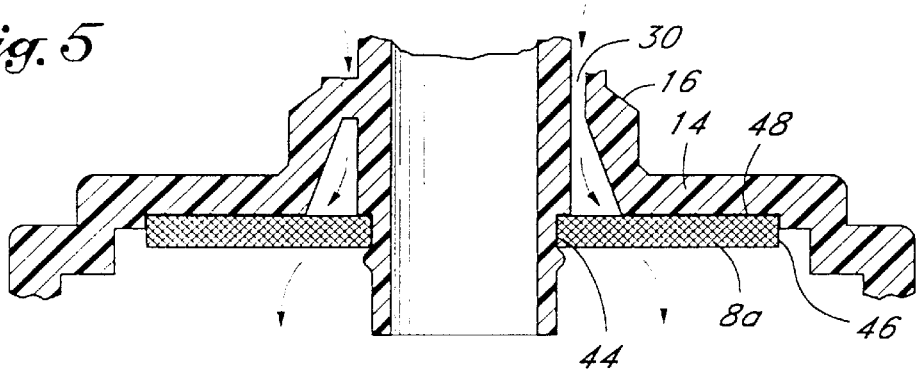
FIG. 5 is an enlarged cross section of the seal member and air flow passage showing another embodiment of the present invention.

FIG. 5 shows another embodiment. In this embodiment the seal member 8 is a piece of porous material. In this case the porous material has a flat disk shape. The porous seal member 8*a* is secured to the inner surface 48 of the middle portion 14 of the body 4 and to the notch 36 on the outer surface of the central piece 6, for example, with glue. Thus, the porous seal member is not movable or bendable. The thickness and density of the porous seal member 8*a* and the dimension of the cross section of the gas passage are adjusted so that the porous seal member will impose enough resistance to stop or at least significantly reduce the liquid flow from the bottle 1 while the air can easily flow into the bottle 1 through the gas passage 30.

In the above described embodiments, it is not necessary to use only one seal member and the seal member does not have to be a single integral piece. If there are several gas passages or the gas passage has several channels, several seal members or several pieces of a seal member can be used as long as all of the gas passages are covered.

Figure 6:
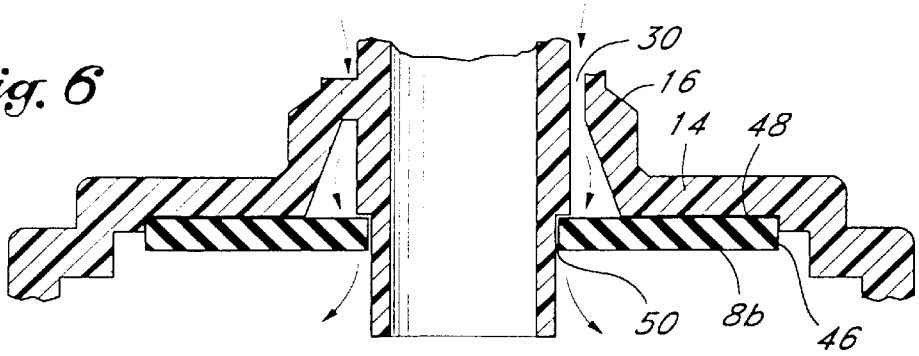
FIG. 6 is an enlarged cross section of the seal member and air flow passage showing still another embodiment of the present invention.

FIG. 6 shows still another embodiment. In this embodiment, the seal member 8*b* is not totally covering the gas passage 30. Instead a gap 50 is formed between the seal member 8*b* and the outer surface of the central piece 6. The seal member 8*b* can be made of the same material as the body 4. Preferably, the seal member 8*b* is molded with the body 4 as an integral structure. Obviously, there are many ways of configuring the gap 50. However, the geometry and the dimension of the gap 50 should be such that the gap 50 imposes enough resistance on liquid flow but allows gas to flow easily and quickly.

The present invention has been described above. It is obvious to one skilled in the art that modifications and variations can be made without departing from the principles and spirit of the present invention. Those modifications and variations are also within the scope of the present invention.

What is claimed is:

1. A liquid container cap adapted to automatically release vacuum generated during expulsion of liquid contained in the liquid container, comprising:

a body having a cylindrical lower portion for receiving the liquid container, an upper portion with a central hole along a longitudinal axis of the body, and a middle portion having a disk shape connecting the lower and the upper portions;

a cylindrical central piece having a liquid passage along a longitudinal axis of the cylindrical central piece, a top section, a middle section, a bottom section, and an outer surface, said outer surface having a stepped configuration with the top section having a larger outer diameter than that of the middle section, said central piece mounted in the central hole of the upper portion of the body with the longitudinal axis of the cylindrical central piece parallel to that of the body, wherein the outer surface of the middle section of the central piece and inner surface of the upper portion of the body define a gas passage, wherein a stopper is mounted on the top section of the central piece without blocking the liquid passage;

a seal sheet having a disk shape with a first edge and a second edge and placed in the gas passage with the first edge adjacent the outer surface of the central piece between the bottom section and the middle section and the second edge extending outwardly along an inner surface of the middle portion of the body; and a closure having a hole aligned with the stopper and a cylindrical wall for engaging with the body and the central piece, said closure slidably coupled to the top section of the central piece and adapted to close or open the liquid passage and said gas passage through engagement between said closure and said central piece and between said closure and said upper portion of said body.

2. The liquid container cap of claim 1, wherein the body and the central piece are molded as an integral structure.

3. The liquid container cap of claim 1, wherein the bottom section of the central piece extends into the lower portion of the body, so that air bubbles are prevented from entering the liquid passage.

4. The liquid container cap of claim 1, wherein the first edge of the seal sheet is fixed while the second edge is free.

5. The liquid container cap of claim 1, wherein the second edge of the seal sheet is fixed while the first edge is free.

6. The liquid container cap of claim 1, wherein the seal member is made of porous material.

7. A bottle cap comprising:

a body having an upper portion with a first projection on the outer surface of said upper portion, a middle portion, a lower portion, and a through hole along a longitudinal axis of said body, wherein said upper portion has a diameter smaller than that of said lower portion, said middle portion is disk shaped and connects said upper and lower portions, and said lower portion is cylindrical with a diameter for receiving a bottle;

a central piece having a liquid passage positioned in said through hole of said body, wherein said central piece has a stepped cylindrical outer surface divided into a top section, a middle section, and a bottom section along said longitudinal axis with said top section having an outer diameter larger than that of said middle section, and said gas passage is defined by said inner surface of said upper portion and said middle section of said outer surface of said central piece;

a seal member placed in said gas passage, which allows the passage of gas but not the passage of liquid; and a closure having a cylindrical wall for engaging with said body and said central piece, and further having a second projection on the inner surface of said cylindrical wall, wherein said closure is coupled to said central piece and adapted to close or open said liquid passage and said gas passage simultaneously, and wherein through the engagement of said first and second projections, said gas passage is closed.

8. The bottle cap of claim 7, wherein said seal member is a resilient flexible sheet, said sheet having a disk shape with an inner edge secured to said outer surface of said central piece between said middle section and said bottom section and a free outer edge extending outwardly along an inner surface of said middle portion of said body so that said gas passage is covered by said seal member and part of said seal member is movable.

9. The bottle cap of claim 7, wherein said seal member is a resilient flexible sheet, said sheet having a disk shape with a free inner edge adjacent to said outer surface of said central piece between said middle section and said bottom section and an outer edge extending along and secured to an inner surface of said middle portion of said body so that said gas passage is covered by said seal member and part of said seal member is movable.

10. The bottle cap of claim 7, wherein said seal member is a sheet of porous material, said sheet having a disk shape with an inner edge secured to said outer surface of said central piece between said middle section and said bottom section and an outer edge extending along and secured to an inner surface of said middle portion of said body so that said gas passage is covered by said seal member.

11. A cap for a container comprising:

a body having at least two passages formed therein, a first passage for the flow of liquid into and out of said container, and a second passage for the flow of gas; and a closure device mounted on said body, having a central member, wherein said central member engages said body when said closure device is in a closed position preventing said liquid from passing through said first passage, and wherein said closure device, when in said closed position, prevents said gas from passing through said second passage.

12. The cap of claim 11, wherein said closure device automatically closes said first passage while closing said second passage.

13. The cap of claim 11, wherein said closure device automatically opens said second passage while opening said first passage.

14. The cap of claim 11 further comprising a hollow internal member having a liquid passage, wherein said closure device engages said internal member when said closure device is in said closed position.

15. The cap of claim 11, wherein said closure device has one or more extensions that engage said body to close said gas passage when said closure device is in said closed position.

* * * * *